United States Patent [19]

Tyler

[11] Patent Number: 4,722,276

[45] Date of Patent: Feb. 2, 1988

[54] AIR BLAST FOR PREVENTING CONTACT OF WET INK SHEETS WITH PRINTING PRESS DELIVERY MECHANISMS

[76] Inventor: Jack D. Tyler, 3017 Morton, Fort Worth, Tex. 76107

[21] Appl. No.: 891,955

[22] Filed: Aug. 1, 1986

[51] Int. Cl.[4] ..... B41F 13/04

[52] U.S. Cl. ..... 101/419; 101/420; 271/195; 406/88

[58] Field of Search ..... 101/419–420, 101/408, 230, 183, 231; 271/195, 309, 204; 406/88

[56] References Cited

U.S. PATENT DOCUMENTS

| | | | |
|---|---|---|---|
| 2,730,950 | 1/1956 | Grassi | 101/420 |
| 2,736,106 | 2/1956 | Offen | 101/420 X |
| 4,372,550 | 2/1983 | Woods | 271/195 |
| 4,395,949 | 8/1983 | Jeschue | 101/420 |
| 4,444,531 | 4/1984 | Baker et al. | 271/195 |
| 4,552,069 | 11/1985 | Jahn | 101/420 |
| 4,572,071 | 2/1986 | Cappel et al. | 101/183 |

*Primary Examiner*—E. H. Eickholt
*Attorney, Agent, or Firm*—James E. Bradley

[57] ABSTRACT

A printing press has an apparatus for preventing contact of wet ink sheets with the chain delivery mechanism. The printing press has an impression cylinder and a blanket cylinder through which sheets are drawn by the chain delivery mechanism. The chain delivery mechanism has two sprockets mounted to a shaft, each of which rotates runs of chain to pull the sheets from the cylinders. A nozzle is mounted adjacent the shaft for discharging jets of air against the sheets to push them away from the shaft. An air compressor supplies air to the nozzle. A regulator valve allows the pressure at the nozzle to be varied depending upon the type of sheets.

6 Claims, 4 Drawing Figures

Fig. 2
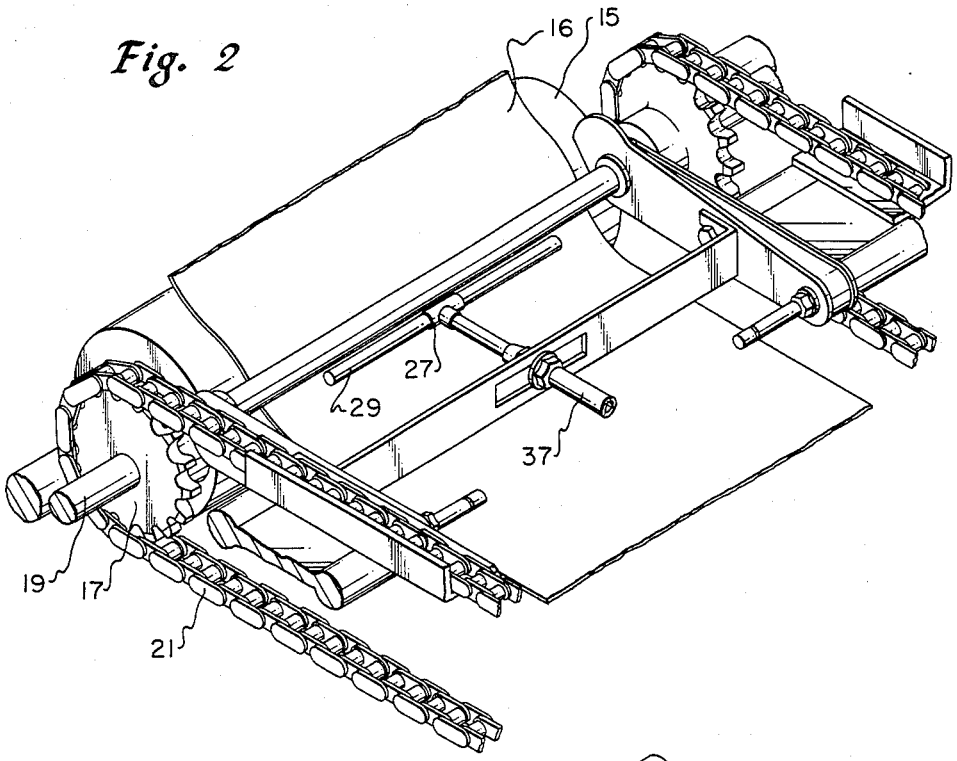
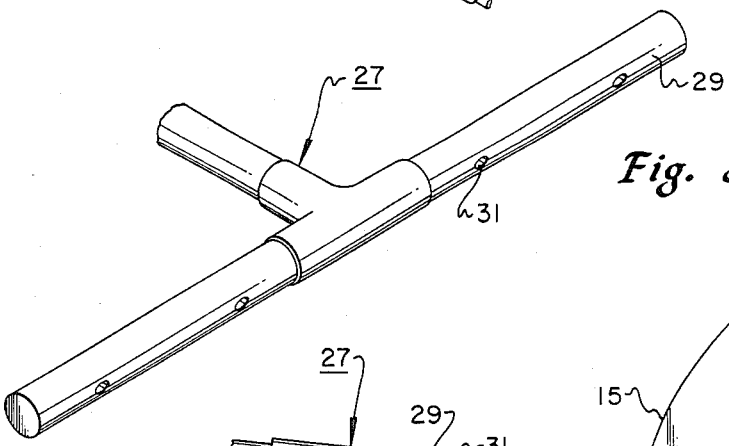
Fig. 3
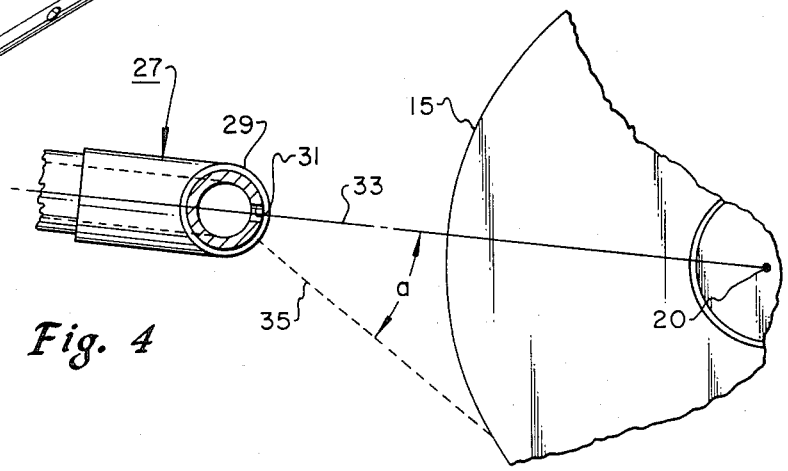
Fig. 4

AIR BLAST FOR PREVENTING CONTACT OF WET INK SHEETS WITH PRINTING PRESS DELIVERY MECHANISMS

BACKGROUND OF THE INVENTION

1. Field of the Invention

This invention relates in general to printing presses, and in particular to an apparatus for preventing contact of wet ink on printed sheets with the printing press chain delivery mechanisms.

2. Description of the Prior Art

In printing presses with chain delivery mechanisms, the sheet is drawn between a blanket cylinder and an impression cylinder, then gripped by a chain delivery mechanism and pulled rearwardly where it is deposited in a stack. The chain delivery mechanism has a pair of sprockets mounted next to the impression cylinder. A chain extends around each of the sprockets and has horizontal upper and lower runs. A gripping mechanism is mounted to the chains for gripping the leading edge of the sheet as it passes through the impression cylinder. The sprockets are mounted on a shaft that is parallel with the axis of the impression cylinder.

A long standing problem is avoiding contact of the wet ink on the sheets with the shaft that extends between the two sprockets. Any contact of the shaft with the ink will likely cause smearing. One system to avoid smearing comprises placing small wheels on the shaft. There are several different wheel designs. The wheels are preferably positioned to contact the sheet where no ink is deposited. This is not always possible. In sheets with an extensive amount of ink coverage, the wheels will contact the ink and cause smearing. Other devices have been proposed and used but not entirely satisfactorily.

SUMMARY OF THE INVENTION

In this invention, a nozzle having at least one opening is mounted adjacent the shaft for discharging a jet of air against the sheets as they are pulled away from the cylinders. The air pushes the sheets away from the sprocket shaft, avoiding smearing. The nozzle is connected to an air compressor which supplies pressurized air. A manually operable regulator valve is located in the line for selectively varying the pressure to the nozzle. The pressure varies substantially depending upon the type of sheets.

BRIEF DESCRIPTION OF THE DRAWING

FIG. 2 is a partial perspective view showing a portion of the nozzle apparatus of FIG. 1.

FIG. 3 is an enlarged perspective view showing a portion of the nozzle apparatus of FIG. 1.

FIG. 4 is a schematic view of a portion of the nozzle of FIG. 1, illustrating its orientation relative to the impression cylinder.

DESCRIPTION OF THE PREFERRED EMBODIMENT

Figure 1:
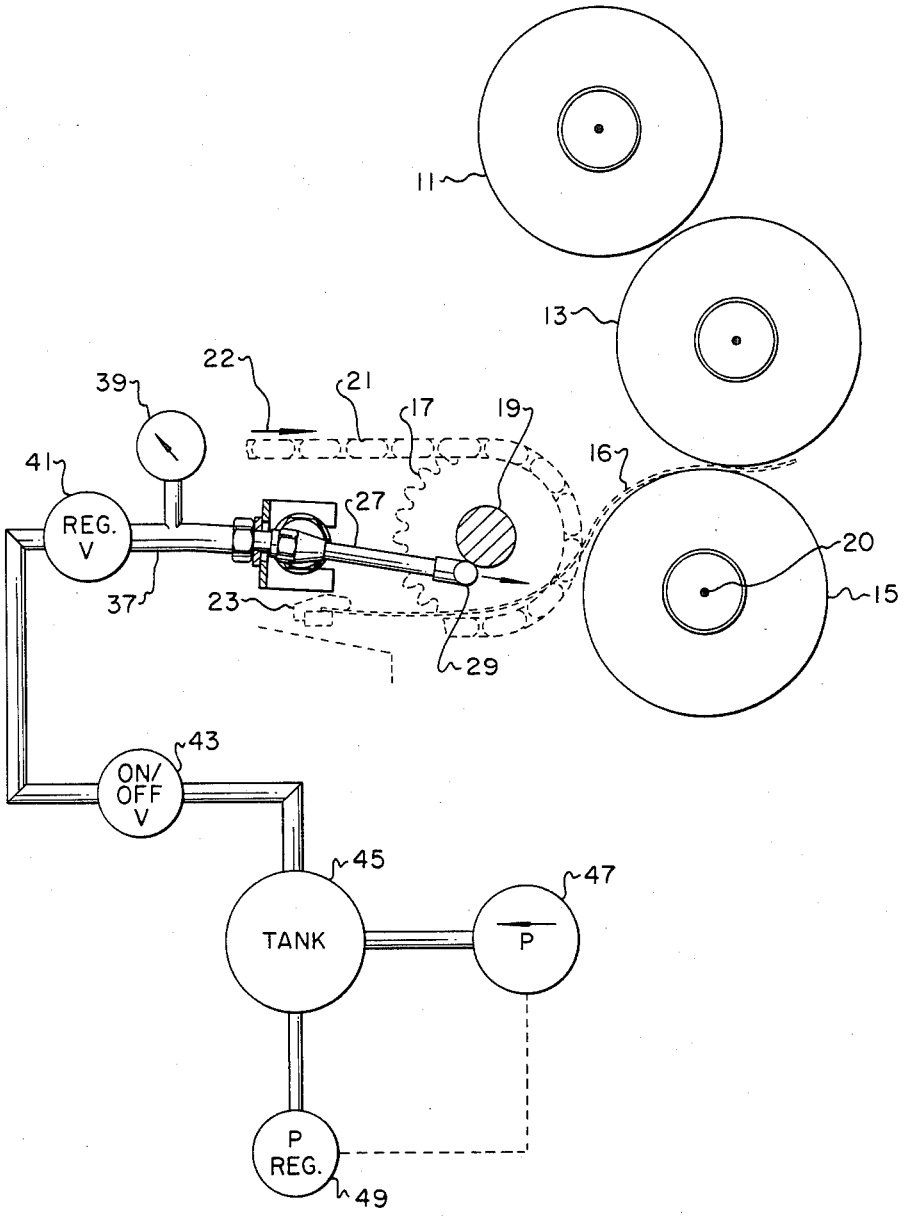
FIG. 1 is a schematic view of a portion of a printing press illustrating a nozzle apparatus constructed in accordance with this invention.

Referring to FIG. 1, the printing press has a plate cylinder 11 that is coated with ink. The plate cylinder 11 rotates in contact with a blanket cylinder 13. The blanket cylinder 13 includes a rubber mat or blanket mounted thereon and is coated with ink and rotates in contact with an impression cylinder 15. The image is transferred to the paper sheets 16 as they are fed between the impression cylinder 15 and the blanket cylinder 13.

The chain delivery system includes a pair of sprockets 17 that are mounted side by side immediately rearward of the impression cylinder 15. Sprockets 17 are mounted to a shaft 19 which has an axis that is parallel with the axis 20 of the impression cylinder 15. A pair of chains 21 rotate around each sprocket 17. Chain 21 has an upper horizontal run and is drawn toward the impression cylinder 15 as shown by the arrow 22. The lower horizontal run of chain 21 is drawn away from the impression cylinder 15. A gripping mechanism 23 is mounted to the chain 21 for gripping each sheet 16 as it rolls through the cylinders 13 and 15. The problem that has occured in the past is the contact of the sheets 16 with the shaft 19 or with skeleton or star wheels (not shown) which may be mounted to the shaft 19.

Contact of the sheets 16 with the shaft 19 is prevented by a nozzle 27 which discharges compressed air. As shown in FIG. 3, nozzle 27 has a tip 29 that is a horizontal tube extending parallel with the axes of shaft 19 and impression cylinder 15 (FIG. 1). Tip 29 is mounted directly below shaft 19 in the embodiment shown and has a length that is greater than half the width of the printed sheets 16. Each end of the tip 29 is closed, making it a chamber. A plurality of circular openings 31 are formed in the forward side of the tip 29 for discharging air against the sheets 16 (FIG. 1) as they are drawn from the impression cylinder 15. In the preferred embodiment there are four openings 31 equally spaced horizontally apart from each other. A sufficient distance between the openings 31 is provided to discharge air against more than half the width of the sheets 16.

The diameter of each opening 31 is in the range from 0.02 inch to 0.06 inch and preferably 0.04 inch. As shown in FIG. 4, each opening 31 is preferably centered on a radial line 33 emanating from the axis 20 of the impression cylinder 15 and passing through the axis of the tip 29. The openings 31 can also be oriented at selected angles a below the radial line 33 up to 40 degrees, which is shown by the dotted line 35. The maximum discharge angle a of 40 degrees is suitable for very heavy paper stock while the angle a of zero degrees is suitable for paper stock of lighter weights.

Referring again to FIG. 1, the nozzle 27 is connected to a conduit 37. A pressure gauge 39 may be located in the conduit 37 and visible to the operator of the press. A manually operable regulator valve 41 will be located in conduit 37 and accessible easily by the press operator. Valve 41 can be rotated to provide pressures in the conduit 37 and at tip 29 that vary from about 2 psi (pounds per square inch) to 60 psi.

Conduit 37 is also connected to an on/off valve 43. Conduit 37 extends past the valve 43 to a tank 45 containing air pressure. Tank 45 is connected to a conventional compressor 47. A pressure regulator 49 senses the pressure in the tank 45 and turns the compressor 47 on and off to maintain a desired pressure in the tank 45 of about 80 psi. Valve 43 may be connected electrically to the printing press so that it will automatically turn on the air pressure to the nozzle 27 once the printing press begins to run.

In operation, an operator will turn on the press. Sheets 16 containing wet ink on one side will pass between the cylinders 13 and 15. Each sheet 16 will be gripped by the gripper mechanism 23 and pulled from the impression cylinder 15 rearwardly. The gripper mechanism 23 will deposit the sheets 16 in a stack (not shown). The valve 43 will be open supplying pressurized air to the nozzle 27 to discharge against the sheets 16 to prevent them from contacting the shaft 19. The impact of the air blows the sheets away from the shaft 19.

Normally, the operator will begin at a fairly high pressure, such as around 60 psi. He will then close the regulator valve 41 to reduce the air pressure at nozzle 27 to a minimum level that will keep the sheets 16 from contacting shaft 19. The minimum level depends upon the weight of the paper and whether the paper is coated or uncoated. The amount of pressure also depends upon the length of each sheet and can also vary depending upon the amount of ink coverage. Higher pressure than needed may cause whipping of the ends of the sheets as they are released from the impression cylinder 15. The higher pressure also expends air, and thus energy.

For $8\frac{1}{2}\times 11$ inch paper, the following air pressures at nozzle 27 are preferred for the various types of paper: 20 pound paper, 2 psi; 65 pound cover, 18 psi; 70 pound offset, 3 psi; and 80 pound enamel, 25 psi. For $11\times 17$ inch sheets, the following air pressures are preferred: 65 pound cover, 30 psi; 80 pound cover (50% ink coverage), 45 psi; 80 pound cover (75% ink coverage), 60 psi; 80 pound text enamel, 60 psi and 40 degree angle a; and 80 pound card stock 8 or 10 point, 60 psi and 40 degree angle a. For other paper weights and types, the pressure will be selectively adjusted by the operator to a level where it is at the lowest pressure possible that will still maintain the sheets away from the shaft 19. The enamel coated stock of greater length does not have pores and tends to stick to the blanket cylinder 13 and buckle. The 40 degree nozzle helps the buckle from forming.

The invention has significant advantages. The nozzle is easily installed on existing presses. It can be adapted to various configurations of presses. It successfully keeps the wet ink on the sheets from contacting the sprocket shaft. The nozzle apparatus is inexpensive and easy to operate.

While the invention has been shown in only one of its forms, it should be apparent to those skilled in the art that it is not so limited, but is susceptible to various changes without departing from the scope of the invention.

I claim:

1. In a printing press having an impression cylinder and a blanket cylinder, a chain delivery means for withdrawing sheets from between the cylinders including a pair of sprockets located adjacent the cylinders carrying a chain with an upper run leading toward the cylinders and a lower run leading away from the cylinders, the shaft carrying the sprockets, and gripping means carried by the chain for engaging leading edges of the sheets to carry them away from the cylinders, an improved means for preventing the sheets from contacting the shaft while the ink is still wet, comprising in combination:

a nozzle having at least one opening mounted adjacent the shaft for discharging a jet of air against the sheets to push them away from the shaft;

air compressor means including a compressor for supplying pressurized air to the nozzle; and manually operable regulator valve means for selectively and manually varying the pressure to the nozzle depending upon the type of sheets.

2. In a printing press having an impression cylinder and a blanket cylinder, a chain delivery means for withdrawing sheets from between the cylinders including a pair of sprockets located adjacent the cylinders carrying a chain with an upper run leading toward the cylinders and a lower run leading away from the cylinders, the shaft carrying the sprockets, and gripping means carried by the chain for engaging leading edges of the sheets to carry them away from the cylinders, an improved means for preventing the sheets from contacting the shaft while the ink is still wet, comprising in combination:

a nozzle mounted adjacent the shaft and having a tip with a plurality of openings spaced horizontally apart from each other for discharging jets of air against the sheets to push them away from the shaft;

air compressor means including a compressor for supplying pressurized air to the nozzle; and manually operable regulator valve means for selectively and manually varying the pressure to the nozzle depending upon the type of sheets.

3. The apparatus according to claim 2 wherein all of the openings are oriented along lines that substantially are in the range from 0 degrees to 40 degrees with respect to a radial line passing from the axis of the blanket cylinder to the tip of the nozzle.

4. The apparatus according to claim 2 wherein each of the nozzles has a diameter that is substantially in the range from 0.02 inch to 0.06 inch.

5. The apparatus according to claim 4 wherein the number of openings in the nozzle is in the range from 2 to 6.

6. In a printing press having an impression cylinder and a blanket cylinder, a chain delivery means for withdrawing sheets from between the cylinders including a pair of sprockets located adjacent the cylinders carrying a chain with an upper run leading toward the cylinders and a lower run leading away from the cylinders, the shaft carrying the sprockets, and gripping means carried by the chain for engaging leading edges of the sheets to carry them away from the cylinders, an improved means for preventing the sheets from contacting the shaft while the ink is still wet, comprising in combination:

a nozzle having a tip that is a horizontal tube mounted immediately below and having an axis parallel with the shaft, the tip having from 2 to 6 circular openings spaced horizontally apart from each other for discharging jets of air against the sheets to push them away from the shaft;

all of the openings having a diameter from 0.02 inch to 0.06 inch and being oriented in the same direction to discharge a jet of air along a line that is in the range from 0 degrees to 40 degrees with respect to a radial line passing from the axis of the blanket cylinder to the axis of the tip of the nozzle;

air compressor means including a reservoir tank and a compressor for supplying pressurized air to the nozzle; and manually operable regulator valve means for selectively and manually varying the pressure to the nozzle depending upon the type of the sheets.

* * * * *